United States Patent [19]

Brookes et al.

[11] 3,995,714

[45] Dec. 7, 1976

[54] MULTI-SECTION LADDER FOR SCALING POLES

[76] Inventors: Malcolm J. Brookes, 30 E. 68th St., New York, N.Y. 10021; James A. Sheridan, Box 295-A, Rte. 1, Englishtown, N.J. 07726; Douglas M. Spranger, 23 Fiske Place, Brooklyn, N.Y. 11215

[22] Filed: Nov. 17, 1975

[21] Appl. No.: 632,707

[52] U.S. Cl. ..... 182/100; 182/178; 182/189; 182/206

[51] Int. Cl.[2] ..... E06C 1/10; E06C 7/48

[58] Field of Search ..... 182/100, 178, 189, 214, 182/206; 403/353

[56] References Cited

UNITED STATES PATENTS

| | | | |
|---|---|---|---|
| 721,427 | 2/1903 | Cope | 403/353 |
| 1,142,072 | 6/1915 | Wingerd | 182/206 |
| 3,232,664 | 2/1966 | McBride | 182/187 |
| 3,460,649 | 8/1969 | Baker | 182/187 |
| 3,901,354 | 8/1975 | Grebausky | 182/172 |

FOREIGN PATENTS OR APPLICATIONS

| | | | |
|---|---|---|---|
| 903,147 | 2/1954 | Germany | 182/93 |
| 484,929 | 9/1953 | Italy | 182/189 |
| 356,886 | 10/1961 | Switzerland | 182/93 |

*Primary Examiner*—Reinaldo P. Machado

[57] ABSTRACT

A portable, light-weight, multi-section step ladder for scaling poles and formed by a main or top section followed by a train of extension sections. Each section includes a single vertical spar and a series of steps secured thereto. The upper end of the main section is provided with an open-loop assembly adapted to engage the pole and to harness this section to the pole when a downward force is exerted thereon, the lower end of the main section terminating in a coupling head. Each extension section is provided at its upper end with a latching piece adapted to engage a coupling head and at its lower end with a coupling head, whereby the main section and the extension sections may readily be interlinked to form a ladder whose length is sufficient to scale the pole.

13 Claims, 18 Drawing Figures

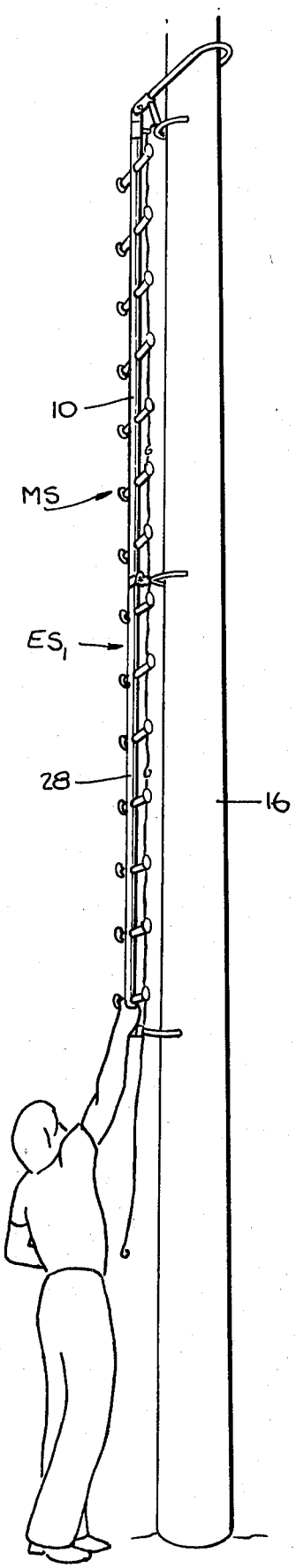
Fig. 5.
Fig. 4.
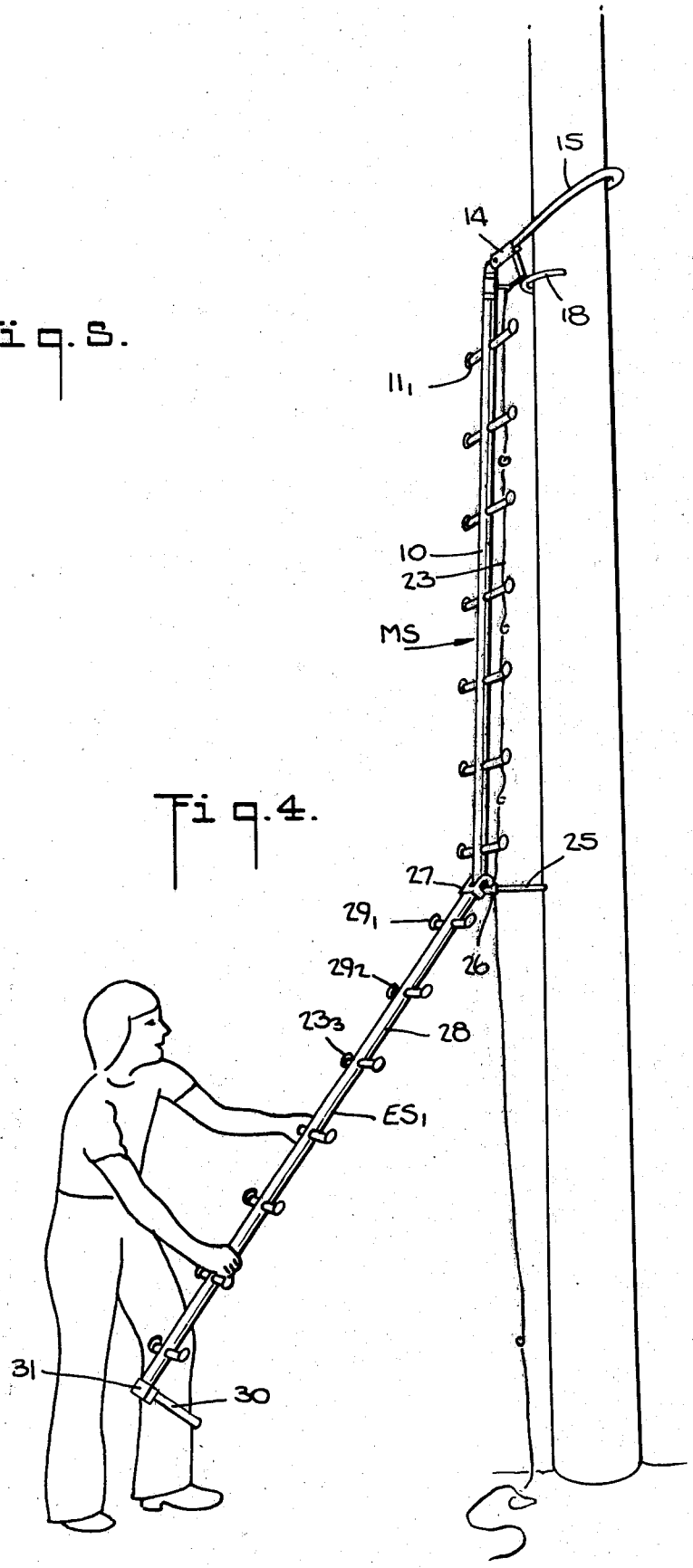

Fig. 6.
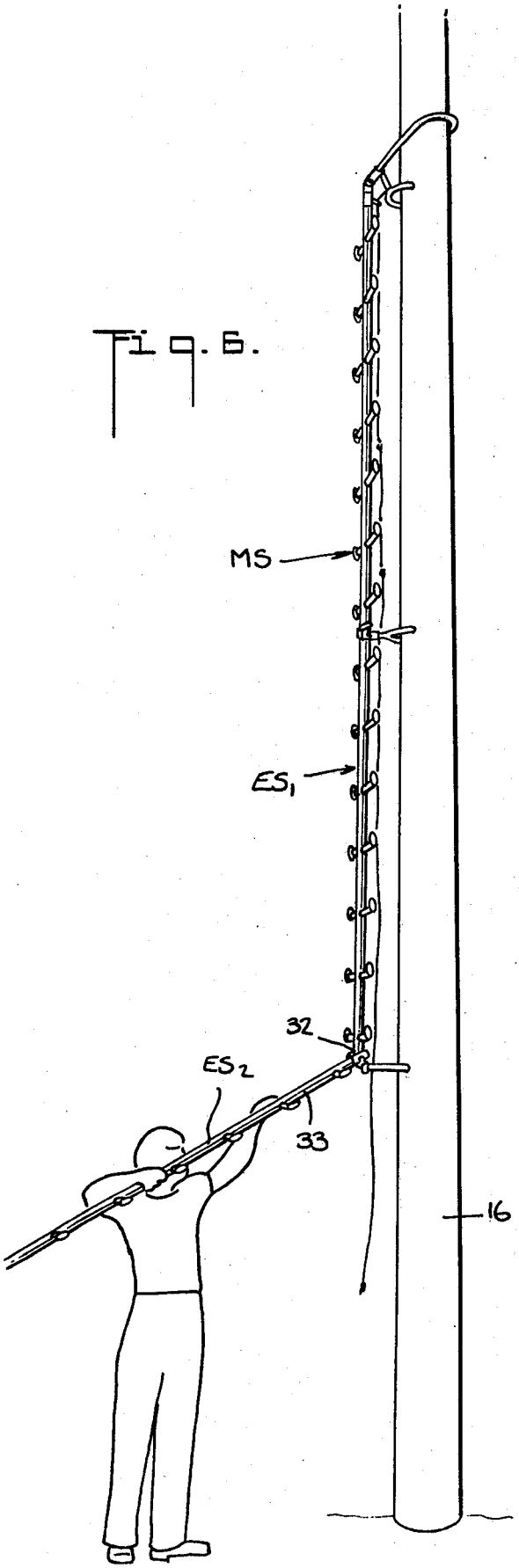
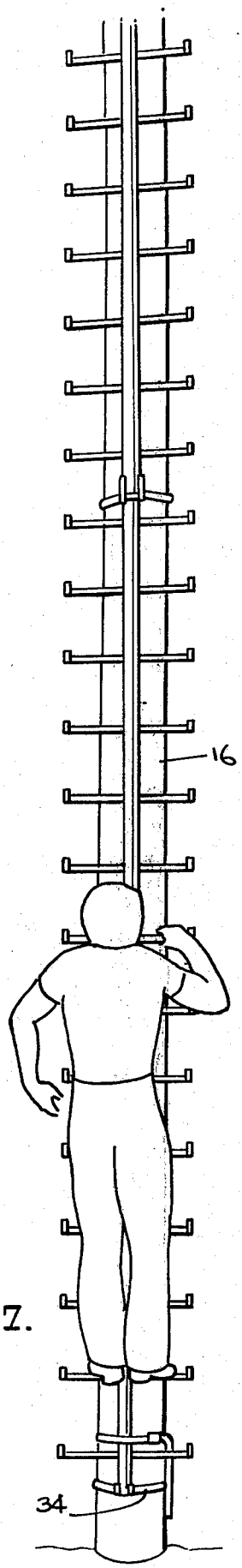
Fig. 7.

Fig.13.
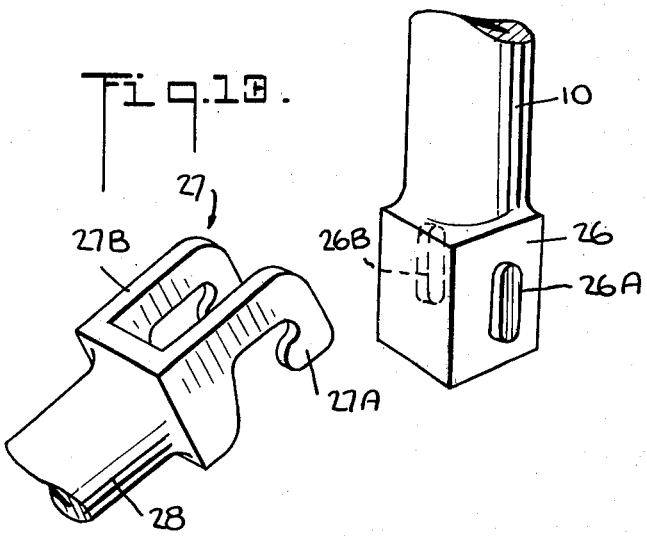
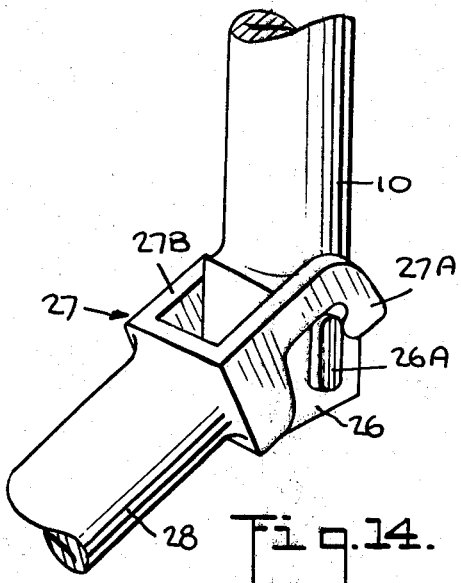
Fig.14.
Fig.15.
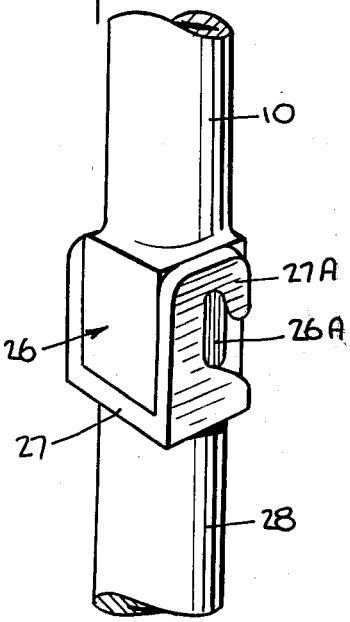
Fig.11.
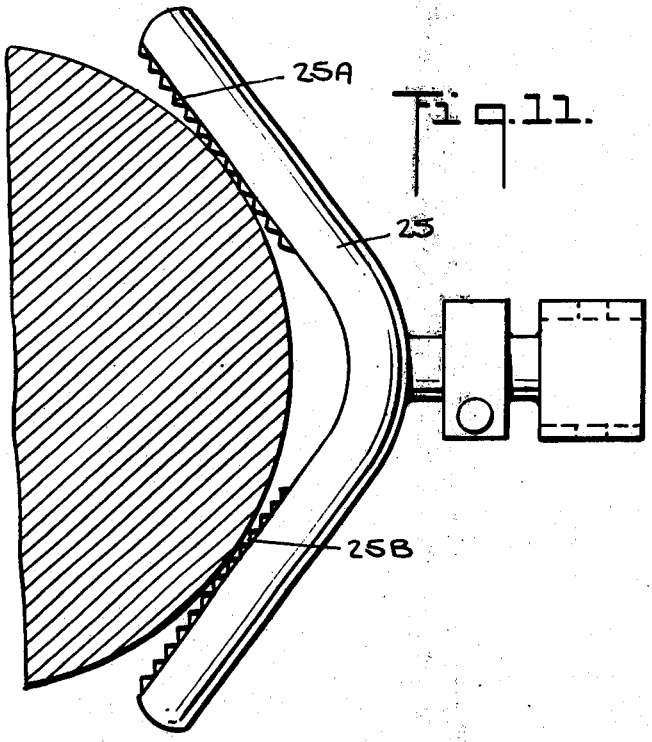
Fig.12.
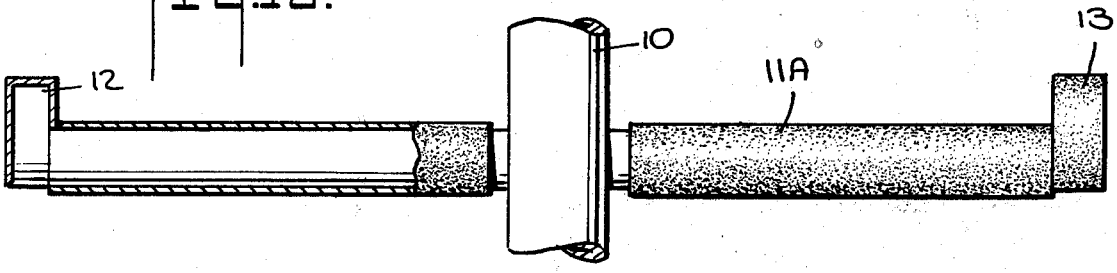

MULTI-SECTION LADDER FOR SCALING POLES

BACKGROUND OF INVENTION

This invention relates generally to step ladders, and more particularly to a multi-section step ladder which is attachable to a pole or mast to facilitate scaling thereof.

The term "linesman" is applicable to one who sets up or repairs communication or power lines strung on utility poles. To climb a utility pole safely, the linesman must acquire skill in the use of leg irons. A typical leg iron consists of a long shank shaped at its lower end into a stirrup and having a sharp gaff welded thereto. The top of the shank is provided with an adjustable extension sleeve which enables the linesman to fit the iron to his leg.

The gaff is designed to bite into the pole to provide anchorage for the climber. In the early days, the poles were made of soft pine and fairly thick gaffs could be used, but with the harder woods currently in use, sharper gaffs are necessary to cut into the wood with sufficient depth to assure safety. But whether the gaff is thick or thin, climbing with leg irons is damaging to the poles, for the poles are gouged by the gaffs. The gashes therein render the poles highly susceptible to decay and reduce their effective life.

A greater objection, however, to the use of climbing irons is that they not only dictate a fairly long training period to instruct a linesman in their proper use, but even when the linesman acquires adequate skill, it takes substantial muscular effort to climb with irons. Also, the linesman must always exercise care to be sure that his irons are in good condition and that the gaffs are properly sharpened.

Another factor one must take into account is that many linesman, splicers and installers do not have occasion to climb poles regularly. Thus they may fall out of training and lose the muscular facility necessary to climbing, as a result of which accidents may occur. Accidents also arise during climbing the leg irons due to so-called "cut-outs." When a climber fails to strike the pole with the point of the gaff at the correct angle, the gaff will not bite in sufficiently and the iron will not hold. Yet the angle of striking gaffs into poles is critical to within a few degrees, and to climb correctly requires an unusual and somewhat unnatural action, often resulting in pain or discomfort.

The problems faced by men who wear climbing irons is compounded for women. While in the past it may have been unthinkable to employ women as linesmen or splicers, the movement toward sexual equality in all fields has reached a point where women are fully eligible for employment in outside-plant jobs heretofore reserved for men.

This is particularly true in the public utility fields where there presently exists a heavy emphasis by the Federal Government on the equal employment of women in outside craft jobs such as linesmen. Indeed, the more appropriate term is now linesperson. While women with proper training are perfectly capable of setting up and repairing lines, they are ill-suited for leg irons.

SUMMARY OF INVENTION

In view of the foregoing, the main object of this invention is to provide a portable step ladder formed by interlinked sections which are attachable to a pole or mast and are supported thereby without a ground anchor, whereby a linesman may scale the full height of the pole without the need for leg irons.

Also an object of the invention is to provide a ladder of the above type whose sections may be interlocked in parallel relation to facilitate storage and carriage thereof.

Among the significant advantages of a multi-section step ladder in accordance with the invention are the following:

A. The sections of the ladder are exceptionally light-weight and easy to handle.

B. The ladder minimizes the discomfort and hazards involved in pole climbing.

C. It makes it much easier for a linesman or other craftsman to work aloft, for it is far more convenient for a linesman to work from the step of a ladder than with his feet straddling a pole.

D. Because the pole-attached ladder entails little more muscular effort to mount than an ordinary ladder, it may be used by women as well as men.

E. The ladder requires no more than a few minutes of instruction in its proper use, thereby doing away with the need for the prolonged training period imposed by climbing irons.

More specifically, it is an object of this invention to provide a low-cost, light-weight, multi-section step ladder formed by a main or top section which is harnessed to the pole, followed by a train of extension sections, the several sections being interlinked to define a ladder whose length is sufficient to scale the pole.

A salient feature of a ladder in accordance with the invention is that the main section thereof is provided with an open-loop assembly for harnessing the section to the pole, which harness may be released simply by relieving weight from the harness and by pulling from the ground a rope coupled thereto. Only a downward force of a few pounds is required to render the harness effective, and no amount of pulling on the rope will thereafter release the harness unless the weight is first relieved. The ladder can safely be used without fear that it will be disengaged from the pole while a linesman is mounted thereon.

Briefly stated, these objects are attained in a multi-section ladder, each section of which is formed by a vertical spar and a series of transverse steps secured thereto. The top or main section is provided at its upper end with an open-loop assembly adapted to engage the pole from one side and to harness this section thereto when a downward force is exerted thereon, the lower end of the main section terminating in a coupling head.

Each extension section which follows the main section is provided at its upper end with a latching piece adapted to engage a coupling head, and at its lower end with a coupling head, whereby the latching piece of each section may be coupled to the coupling head of the section directly thereabove to interlink the sections.

OUTLINE OF DRAWINGS

For a better understanding of the invention as well as other objects and further features thereof, reference is made to the following detailed description to be read in conjunction with the accompanying drawings, wherein:

FIG. 4 illustrates how the intermediate extension section of the ladder is coupled to the top or main section;

FIG. 5 illustrates the manner in which the intermediate extension section coupled to the top section is raised to further elevate the top section;

FIG. 6 shows the bottom extension section being coupled to the intermediate section to complete the ladder installation;

FIG. 7 shows a linesman climbing the installed ladder;

FIG. 11 illustrates the relationship between one of the section stabilizers and the pole;

FIG. 12 shows one of the ladder steps;

FIG. 13 shows a latching piece at the upper end of one ladder section approaching a coupling head at the lower end of another section;

FIG. 14 shows the latching piece in partial engagement with the coupling head;

FIG. 15 shows the latching piece fully engaged with the coupling head;

FIG. 16 shows a climber ascending the ladder installed on the pole;

DESCRIPTION OF INVENTION

First Embodiment

Figure 1B:
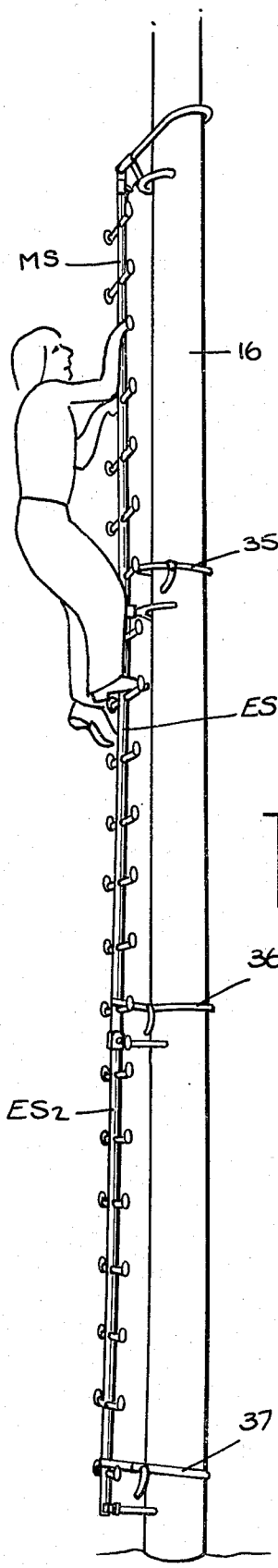
FIG. 1 is a perspective view of the top section of a multi-section portable step ladder in accordance with one preferred embodiment of the invention for climbing poles.
Figure 1:
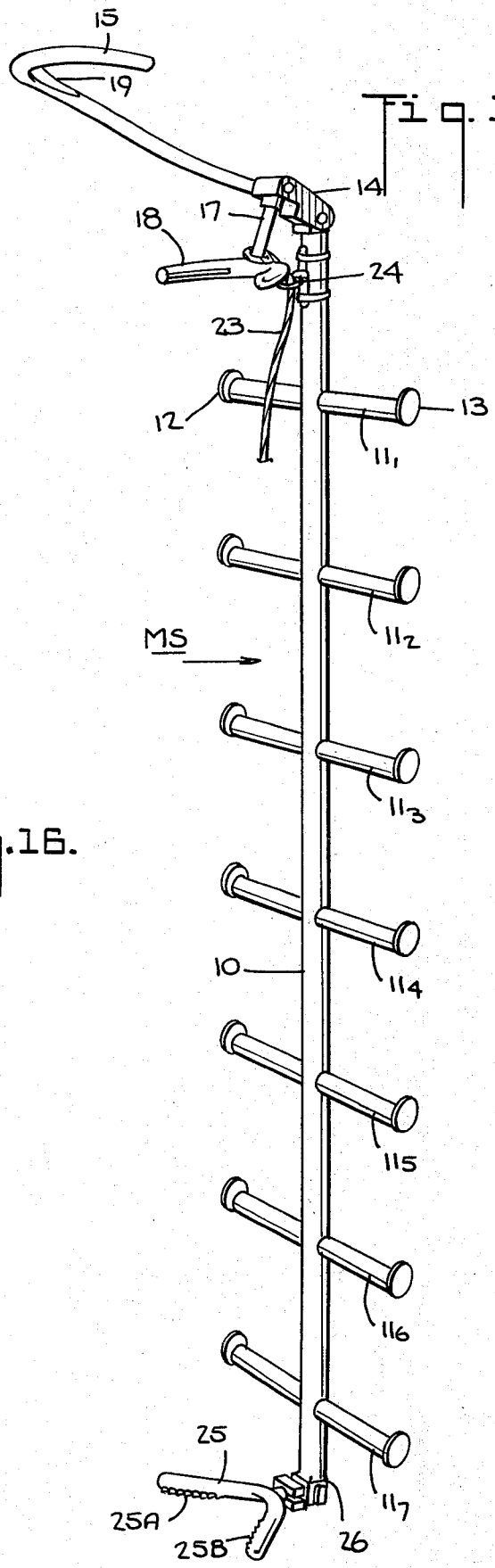

Referring now to FIG. 1, there is shown the top or main section of a portable, multi-section step ladder in accordance with the invention. In the example illustrated, the ladder includes two extension sections which interlink with the main section. It will be appreciated that the number of extension sections used to scale a given mast or pole depends on the height of the pole and the length of each section.

The main section, generally designated as MS, is formed from a single vertical spine or spar 10 having a series of equi-spaced transverse steps $\mathbf{11_1}$, $\mathbf{11_2}$, $\mathbf{11_3}$, etc., secured thereto (see also FIG. 12). To retain the climber's feet, each step is provided with a pair of end caps 12 and 13. The upper surfaces of the steps are treated or coated to have non-slip characteristics. The spar and the steps are preferably fabricated of non-electrically conductive material, such as reinforced fiberglass, so that the light-weight structure has high strength.

Figure 2:
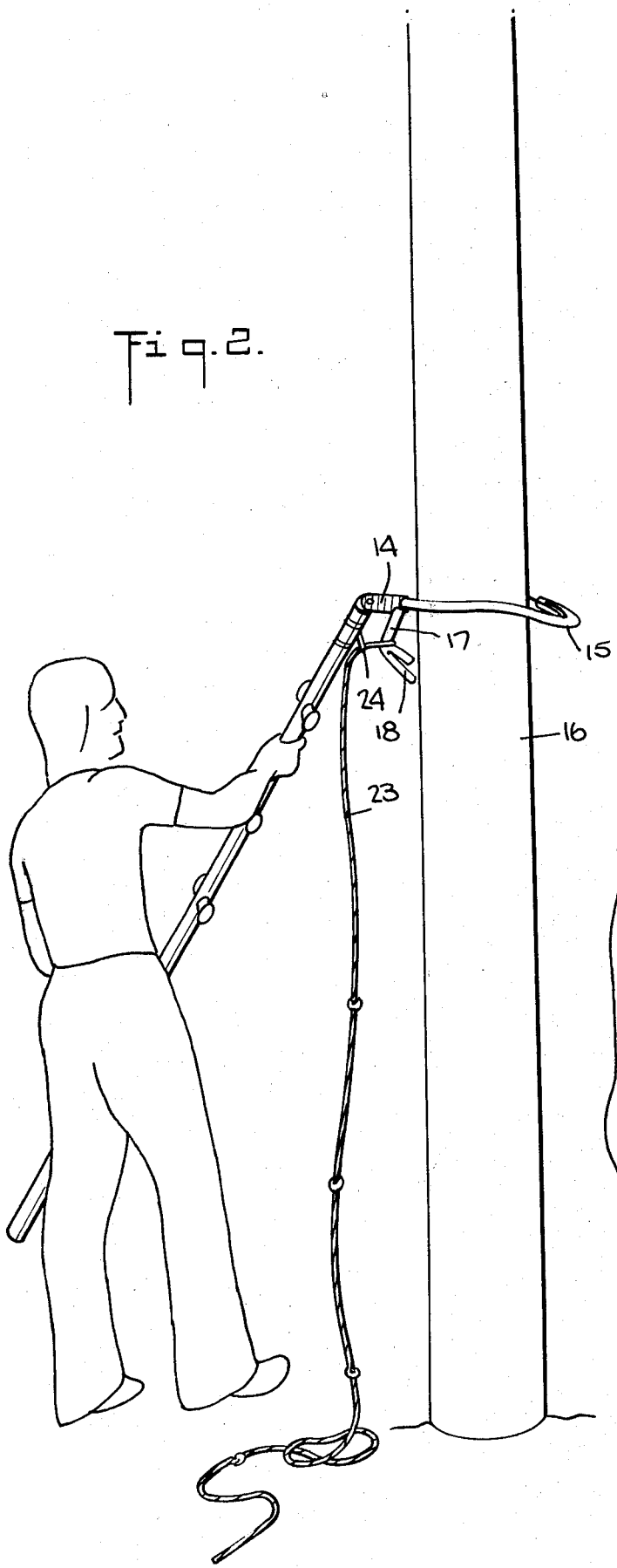
FIG. 2 illustrates the manner in which the open-loop assembly of the main section is brought into engagement with the pole.

At the upper end of spar 10 there is an open-loop assembly including a blcok 14, one end of which is hinged to the upper end of spar 10, the block extending at an angle from the spar. Attached to the free end of the block and extending forwardly therefrom is a crook-shaped arm 15 defining an open loop whose opening makes it possible, as shown in FIG. 2, to embrace one side of pole 16 to be scaled, the curvature of the crook conforming substantially to that of the pole.

Also attached to the free end of block 15 and extending downwardly therefrom is a stub arm 17 which terminates in a forwardly-extending yoke 18 adapted to rest against the opposite side of pole 16. The crook arm configuration is such as to afford ample room to clear ground wires and cables running down the pole.

Figure 3:
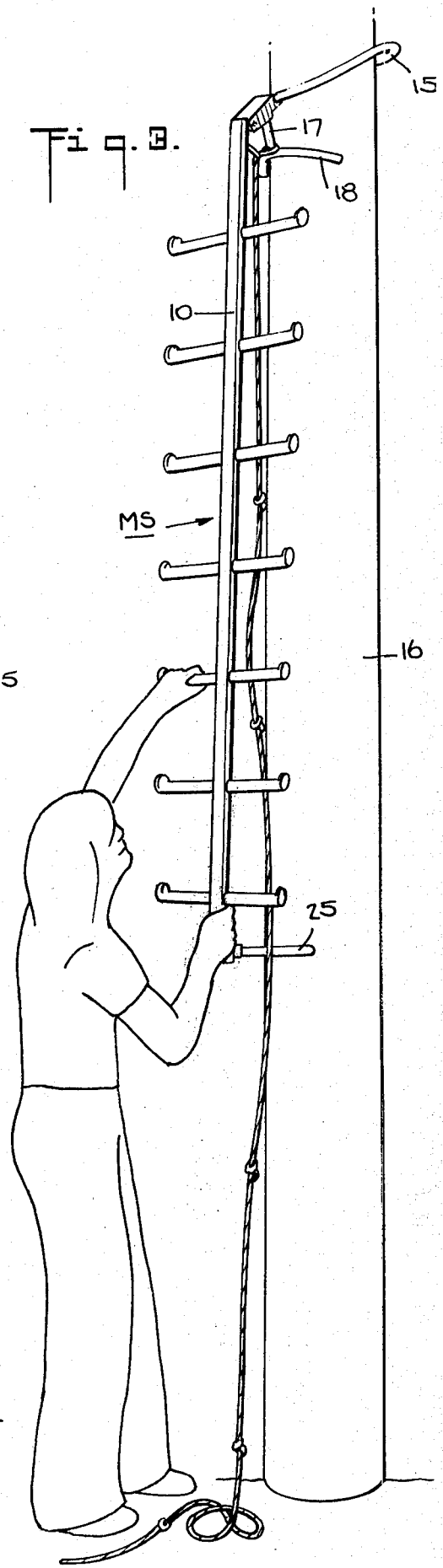
FIG. 3 shows the main section being raised part-way up the pole.

Crook arm 15 and yoke 18 on hinged block 14 form a tiltable harness. When main section MS is manually pushed up the pole, as shown in FIG. 3, this harness automatically adjusts itself by tilting to allow free upward movement, but as soon as one stops pushing up and lets go, the harness then grips this pole to prevent downward movement of the main section. This strip is augmented when a downward force is exerted on the main section by a climber. The dimensions of the harness and of the blades associated therewith and the location and angles of the harness components are so selected as to securely lock the harness tightly around the pole when but a few pounds of downward force are applied thereto.

Figure 9:
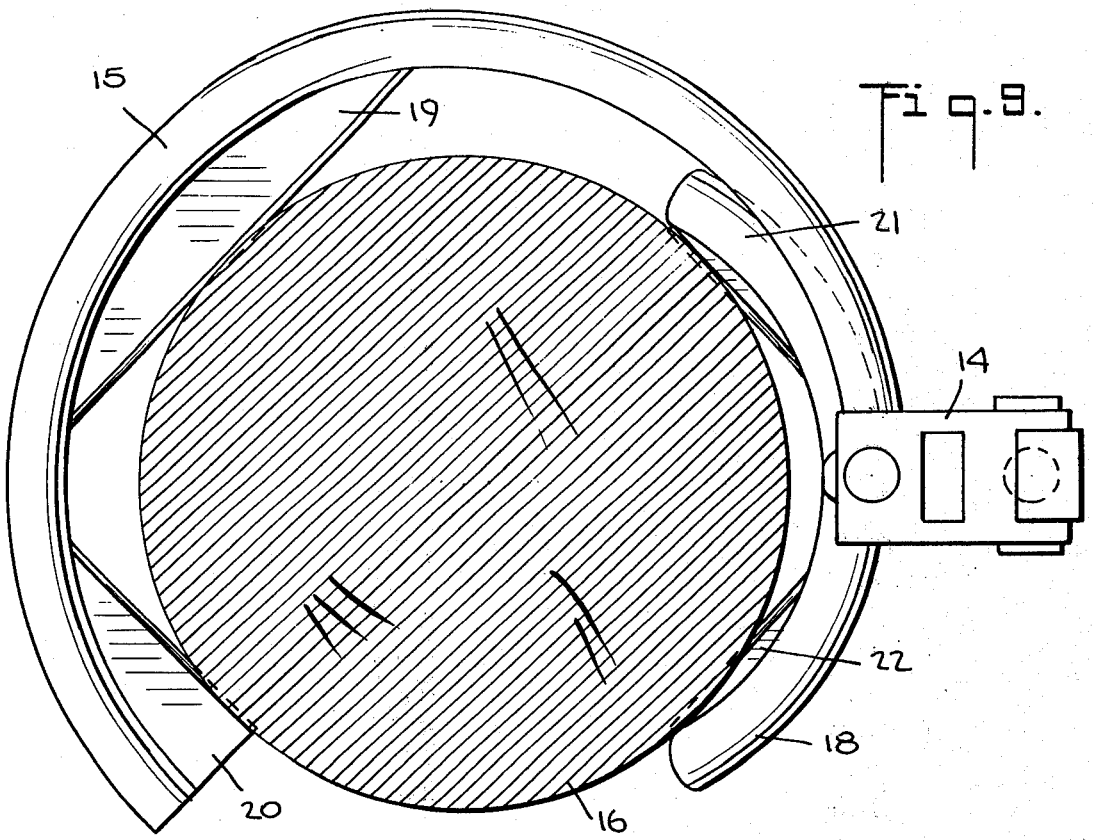
FIG. 9 is a sectional view of the open loop assembly in engagement with the pole.

To insure an effective pinching action, crook arm 15 is provided, as shown in FIG. 9, with blade segments 19 and 20 in a V-formation which slightly cut into the pole to resist displacement of the harness. Alternatively, one may edge the blades with rubber to avoid cutting into the wood, this being particularly useful in the case of synthetic poles made of reinforced concrete or other material. Similarly, yoke 18 is provided with a set of blade segments 21 and 22. In practice, the crook-shaped arm and the yoke are preferably formed of light, strong structural material such as stainless steel or aluminum.

In order to ensure that the harness can fit around large diameter poles, and yet still tilt within the preferred range of operating angles, the blades can be made adjustable to increase or decrease the effective pinching diameter, while maintaining a secure and safe grip. The blades can also be made adjustable with a simple flip-over, or similar mechanism, so that they engage securely on square or rectangular poles.

Figure 8:
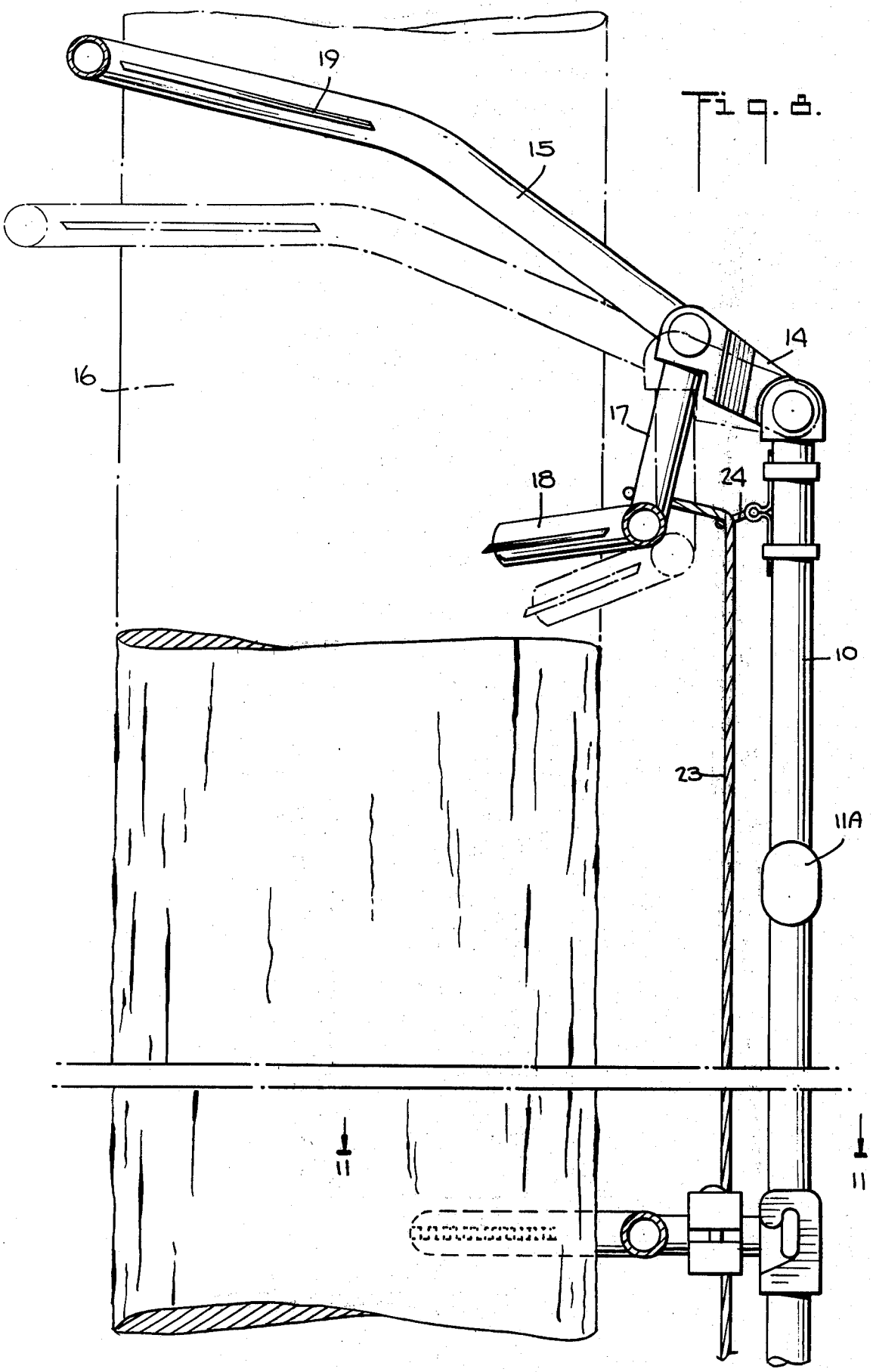
FIG. 8 shows the manner in which the open-loop assembly is disengaged from the pole.
Figure 10:
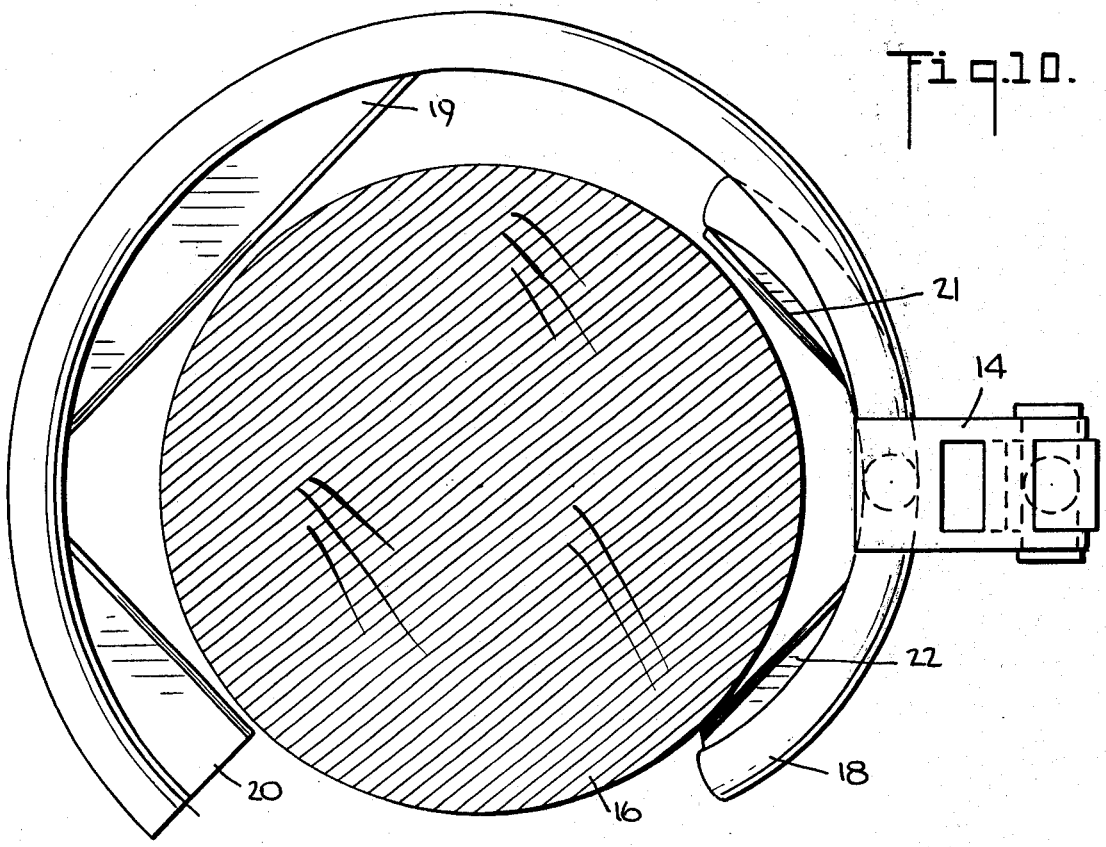
FIG. 10 shows, in section, the open-loop assembly when it is disengaged from the pole.

To retract the tiltable harness in order to withdraw the main section from the pole, a long rope 23 is provided, the upper end of which is tied to arm 17, as shown in FIG. 8, the rope passing through a ring 24 extending from and attached to the upper end of spar 10. Hence by first relieving downward forces and then pulling on rope 23 from the ground level, yoke 18 is thereby withdrawn from the pole in one direction and crook arm 15 is pulled away in the opposite direction to clear the pole (see FIG. 10).

Secured to the lower end of spar 10 is a coupling head 26, and projecting from one face thereof is a Y-shaped stabilizer 25. The legs of the stabilizer are provided with serrated teeth 25A and 25B, as best seen in FIG. 11, to grip the surface of the engaged pole. Stabilizer 25 projects from spar 10 to the same extent as yoke 18 so that when the main section is in place on the pole, spar 10 thereof runs parallel to the pole.

Coupling head 26 is cubical in form and, as best seen in FIG. 13, is provided on opposing faces thereof with a pair of generally-rectangular bosses 26A and 26B. The coupling head cooperates with a latching piece 27 attached to the upper end of spar 28 of the first extension ladder section $\mathbf{ES_1}$ (see FIG. 4). In a three-section ladder, the extension section is the intermediate section.

Latching piece 27 is provided with a pair of C-shaped plates 27A and 27B, which are in parallel relation, the spacing therebetween being about equal to the width of coupling head 26, whereby, as shown in FIG. 14, latching piece 27 is adapted to intermesh with the coupling head and to receive the bosses 26A and 26B thereof. When spar 10 of the main section MS is in axial alignment with spar 28 of the first extension section $ES_1$, the two sections are securely interlinked, as shown in FIG. 15. To break this link, the first extension section must be brought out at an angle with respect to the main section to permit retraction of the latching piece.

As shown in FIG. 4, first extension section $ES_1$ is provided with equi-spaced transverse steps $29_1$, $29_2$, etc., the lower end thereof having a yoke 30 thereon attached on a coupling head 31 which is identical to coupling head 26 and yoke 25 of the main section. After the main section MS is pushed up the pole to a convenient height and harnessed thereon, the first extension section $ES_1$ is linked thereto at an angle. Then, as shown in FIG. 5, the first extension $ES_1$ is brought against the pole that it is parallel thereto and spar 10 of the main section MS is now in axial alignment with spar 28 of the first extension section. The two interlinked sections are then raised to a convenient height to permit linkage thereto of the second or bottom extension section $ES_2$ in the manner illustrated in FIG. 6.

The second extension section $ES_2$ is identical to the first extension section and includes a latching piece 32 at the upper end of a spar 33 and a yoke 34 at the lower end thereof. Now, as shown in FIG. 7, all sections of the ladder are interlinked and lie against the pole, the ladder being harnessed to the pole by the open-loop assembly at the upper end of the main section.

For reasons of security, it is desirable to strap each section of the ladder to the pole. As shown in FIG. 16, main section MS is tied to pole 16 by an adjustable strap 35, first extension section $ES_1$ by a strap 37. These straps are applied after the sections are in place by climbing up the pole, or they may be applied partially as each section is raised up the pole and then snugged tight as the climber ascends each section.

In an actual embodiment of a three-section portable ladder, the total weight thereof is 25 lbs, so that the entire structure can be carried to the site without difficulty. The three sections can be erected and climbed in no more than a minute, and one can be taught to do so in a matter of minutes.

In disassembling the ladder, one has merely to remove the straps, relieve the weight on the portable ladder, and then pull on the rope which runs the full length of the ladder to tilt the harness down, thereby releasing the gripping force. The sections are disconnected from each other by angling one section with respect to the other to retract the latching pieces from the associated coupling heads.

Figure 17:
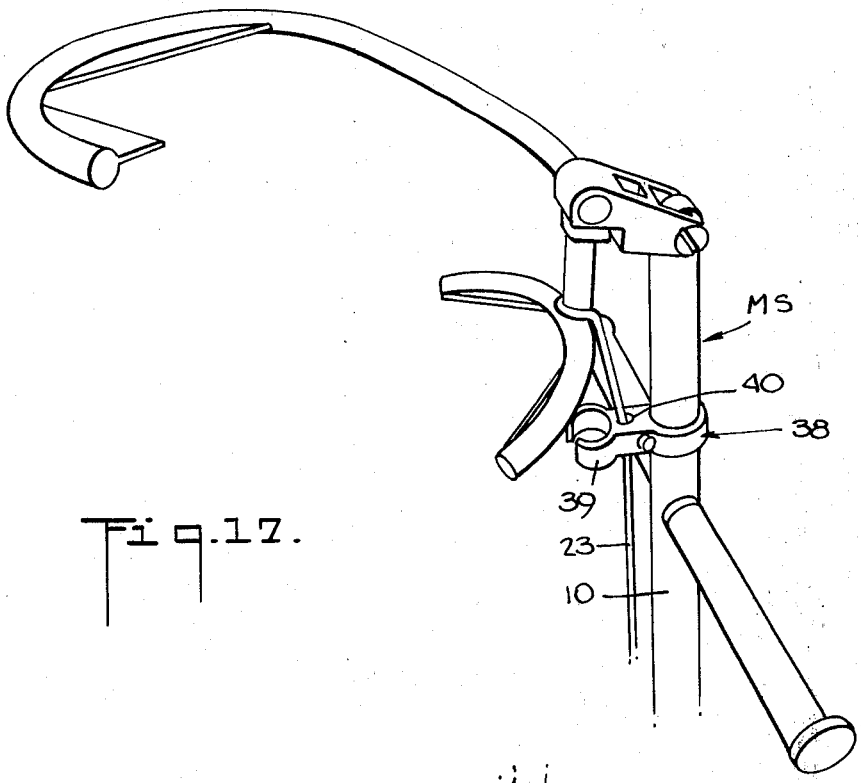
FIG. 17 shows in perspective the upper end of a top section of a multi-section portable step ladder in accordance with another embodiment of the invention.
Figure 18:
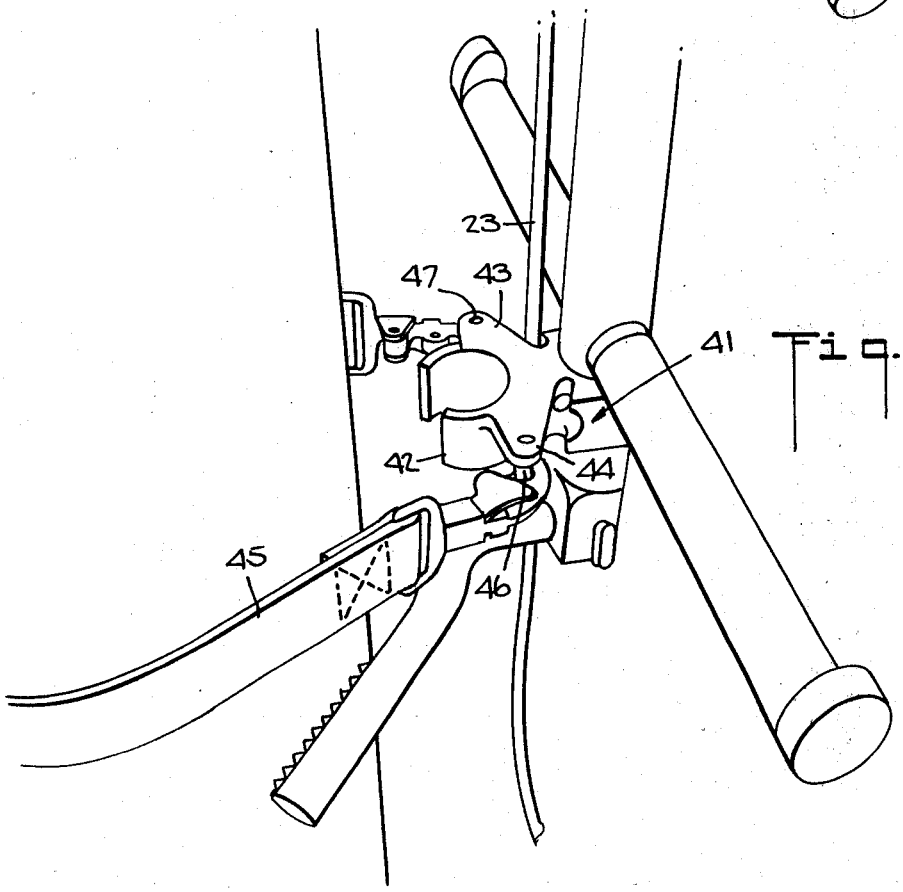
FIG. 18 is a perspective view of the lower end of the same top section.

OTHER EMBODIMENTS:

Referring now to FIGS. 17 and 18, there is shown another embodiment of the invention which is essentially the same as that shown in FIGS. 1 to 16, except that the several sections of the multi-section portable ladder are provided with section joiner clips, thereby making it possible to interlock the sections together one on top of the other in parallel relation to facilitate storage or to make it easier to carry the sections.

For this purpose, the main section MS of the ladder is provided at its upper end adjacent its harness assembly with a joiner clip 38 which is securely coupled to spar 10 and is formed with a U-shaped clamp 39 whose resilient arms are adapted to engage and embrace the spar of a parallel section. A hole 40 is provided in the joiner clip, through which hole the release rope 23 passes. This hole, which keeps the rope in position, replaces ring 24 shown in FIG. 1.

At the lower end of main section MS and on the upper and lower ends of all extension sections $ES_1$ etc. associated therewith is a joiner clip 41 which has a like U-shaped clamp 42 whose arms are adapted to embrace the spar of a parallel section, this clip further including a pair of outstretched ears 43 and 44 which define slots on either side of the clip. These slots serve to dress or contain release rope 23 when the interlinked sections are mounted on a pole to be scaled. A safety strap 45 provided with end buckles is attachable to mounting pins 46 and 47 supported on ears 43 and 44.

While in the embodiments disclosed hereinabove the sections of the ladder are adapted to be interlinked so as to scale a pole to which the main section is harnessed, it is also possible by proper coupling design to hinge together two extension sections to form a locked, caret or A-shaped step ladder which is usable independently of any pole. For this purpose, the coupling head interlinking two extension sections is adapted to function as a hinge to create the apex of the ladder. V-shaped stabilizer feet are secured to the free ends of the spars of the interlinked sections.

The hinged coupling head of this step ladder is adapted to lock at a convenient and safe angle included between the two spars, and the stabilizer feet are anchored on the ground. If necessary, a stabilizing cross member can be added to complete the A-frame form. Alternatively, the two extension sections forming the step ladder may be arranged with their lowermost rungs flush with the ends of their respective spars, rather than displaced from these ends as shown in the figures of the drawing in which event there rungs, which then rest on the ground, serve to stabilize the ladder.

While there have been shown and described preferred embodiments of a multi-section step ladder for scaling poles, it will be appreciated that many changes and modifications may be made therein without, however, departing from the essential spirit thereof. For example, the steps could be mounted alternatively left and right on the spar, rather than as a continuous element across it. This feature reduces the weight of each spar and enables the user to carry it more easily by providing greater clearance space between the steps on any one side of the spar. Further, for convenience of carrying, the steps may be made foldable or otherwise demountable.

We claim:

1. A portable, multi-section ladder for scaling poles, said ladder comprising a main section having at least one extension section linked thereto, each section having a vertical spar and a series of steps mounted thereon at spaced positions, the upper end of the main section being provided with a tiltable open-loop assembly adapted to engage a pole to be scaled and to harness this section thereto when a downward force is exerted thereon, the lower end of each section terminating in a coupling head, a latching piece attached to the upper end of the extension sections adapted to engage the coupling head in the section thereabove, whereby the main section and the extension sections may be interlinked, said open-loop assembly being constituted by a block hinged to the upper end of the spar of the main section, a crook-shaped arm secured to the free end of the block and extending forwardly therefrom to embrace one side of the pole, and a yoke mounted on a stub arm secured to the free end of the block and extending downwardly therefrom in a plane spaced from said crook-shaped arm, said yoke being adapted to rest against the opposite side of the pole, and a long rope tied to said stub arm for tilting said assembly to effect disengagement thereof from said pole, whereby the main section may be released from said pole by pulling on said rope from a ground position.

2. A ladder as set forth in claim 1, wherein said crook arm and said yoke are provided with blade segments to grip the engaged slides of said pole.

3. A ladder as set forth in claim 1, wherein each of said sections further includes a Y-shaped stabilizer attached to the lower end of the spar to engage the pole on the same side as said yoke to maintain the section in parallel relation to the pole.

4. A ladder as set forth in claim 1, wherein each section is provided with an adjustable strap to tie the section to the pole.

5. A ladder as set forth in claim 1, wherein said spars and said steps are formed of light-weight, reinforced fiber glass.

6. A ladder as set forth in claim 1, wherein said steps are provided with end caps to retain a climber's foot thereon.

7. A ladder as set forth in claim 1, wherein said steps are formed with a non-slip surface.

8. A ladder as set forth in claim 1, wherein said coupling head is a cube having a pair of bosses on opposing faces thereof, and said latching piece is formed by a pair of C-shaped plates in parallel relation adapted to intermesh with said head and to receive said bosses.

9. A ladder as set forth in claim 2, wherein said crook-shaped arm and said yoke are formed of tubular metal.

10. A ladder as set forth in claim 5, wherein the legs of said stabilizer are provided with serrations to grip said pole.

11. A ladder as set forth in claim 1, wherein said steps are mounted alternately left and right on said spar.

12. A ladder as set forth in claim 1, wherein each of said sections is provided at the upper and lower ends of said spars with joiner clips, making it possible to interlock said sections in parallel relationship to facilitate storage and carriage of the ladder.

13. A ladder as set forth in claim 1, wherein said latching piece includes means to engage said coupling head to permit positioning of each of said extension sections at a varying angle to the section thereabove, whereby each extension section may be manipulated to upwardly push the section thereabove.

* * * * *